US005992731A

United States Patent [19]

Tani

[11] Patent Number: 5,992,731

[45] Date of Patent: Nov. 30, 1999

[54] POSTCARD

[75] Inventor: Yosikazu Tani, Osaka, Japan

[73] Assignee: Izumi Soft Service Co., Ltd., Osaka, Japan

[21] Appl. No.: 08/906,211

[22] Filed: Aug. 5, 1997

[30] Foreign Application Priority Data

Aug. 5, 1996 [JP] Japan ..... 8-007728
Jun. 19, 1997 [JP] Japan ..... 9-163116

[51] Int. Cl.[6] ..... B42D 15/00
[52] U.S. Cl. ..... 229/92.8
[58] Field of Search ..... 229/92.8, 92, 92.1, 229/300, 70

[56] References Cited

U.S. PATENT DOCUMENTS

| | | | |
|---|---|---|---|
| 2,805,816 | 9/1957 | Morgan | 229/92.8 |
| 4,885,198 | 12/1989 | Kimura | 229/92.8 X |
| 4,887,763 | 12/1989 | Sano | 229/92.8 X |
| 4,892,246 | 1/1990 | Norman | 229/92.8 |
| 5,078,314 | 1/1992 | Shibahara | 229/92.8 |
| 5,205,475 | 4/1993 | Shibahara | 229/92.8 |
| 5,495,981 | 3/1996 | Warther | 229/92.8 X |
| 5,705,243 | 1/1998 | Mehta et al. | 229/92 X |

*Primary Examiner*—Jes F. Pascua
*Attorney, Agent, or Firm*—Oblon, Spivak, McClelland, Maier & Neustadt, P.C.

[57] ABSTRACT

A postcard containing a separable card portion. The postcard has a first sheet and a second sheet which lies on the first sheet. An adhesive layer removably bonds the two sheets together. The first sheet includes a card portion which is surrounded by a cutting line so that it may be separated from the rest of the first sheet. The adhesive layer also firmly holds the card portion in position during mailing so as to avoid the possibility that it becomes separated and lost in mailing. After the postcard is received, the two sheets are peeled apart so that the card portion may then be cut out from the first sheet and used separately from the sheets. The card portion may include a name and address which then can be used as the address information both for the postcard, while it is attached to the sheets, and for the card itself, after it is separated.

5 Claims, 5 Drawing Sheets

POSTCARD

BACKGROUND OF THE INVENTION AND RELATED ART STATEMENT

The present invention relates to a postcard or an envelope in which a portion filled with name and address may be utilized as membership card, certification card, etc., in addition to being used for postal information.

Recently, among varieties of postal matters, it has been increasingly popular to use a type of postcard comprising a sheet of paper having dimensions twice as large as a conventional postcard, in which a sheet is folded down into half to be the same dimensions as conventional postcard and two backside parts thereof formed by such folding being closely joined each other through adhesion or the like in a separable manner. As is known, because of material properties, the folded sheet with its folded backside parts joined closely in a separable manner cannot be restored to the mentioned closely joined state, once the joined portion is peeled. Since the sheet has a dimension twice as large as a postcard, more information such as product information may be described in the backside of the joined sheet than that of a post card. Moreover, information relating to privacy may be described with a sense of security, because the backside of the joined sheet would not be seen by others.

On the other hand, various kind of methods have been proposed as methods for mailing a card together with a postcard or an envelope. The methods include securing a card to the backside of a postcard by means of a removable adhesive, enclosing a card in an envelope, etc., for example.

However, in the mentioned conventional methods, there is a disadvantage such that it is necessary for a sender of postal matter to fill out a sending card with name and address of addressee ( i.e., a card user) either by printing or by hand writing, in addition to a description of the same name and address on the postcard or envelope, otherwise the card user himself must fill up the card with his name and address, etc. after receiving the card. Anyway, repeated description of the same name and address may be rather troublesome work.

Accordingly, the invention was made to solve this problem and has an object of providing a postcard on which a name and address may be utilized also as a part of a card, as it is, and it is not necessary to repeat filling up the card with the same name and address of card user (i.e., addressee information) once filling up the postcard or envelope with required name and address, etc. of the card user.

Another object of the invention is to provide an envelope of which a portion showing name and address of addressee may be utilized or serve also as a recording medium, even in case of a recording medium of a large thickness.

SUMMARY OF THE INVENTION

A postcard according to the present invention comprises a first sheet having a card portion showing addressee information on front side, a second sheet having a backside capable of lying on the backside of said first sheet, and an adhesive layer removably bonding the backside of said first sheet to the backside of said second sheet, and in which the addressee information is surrounded by a cutting line. In the postcard of such construction, after sending and receiving the postcard to an addressee shown on the front side of the first sheet with its backside bonded to the backside of the second sheet through the adhesive layer, the backside of the first sheet and the backside of the second sheet are peeled or separated from each other.

Furthermore, the card portion may be cut out from the first sheet at the mentioned cutting line, whereby the card portion may be utilized independently of the first sheet and second sheet for other uses.

An envelope according to the invention is comprised of a card portion C in which various kinds of information is recorded on the backside filled out with addressee information, or with which recording mediums of various kinds of cards such as a IC card are joined and integrated. Surrounding the card portion C, a cutting line such as perforation is formed. The card portion C has approximately same dimensions as those of prepaid calling card.

Other objects, features and advantages of the invention will become apparent in the course of the following description with reference to the accompanying drawings.

DETAILED DESCRIPTION OF THE PREFERRED EMBODIMENT OF THE INVENTION

Figure 1:
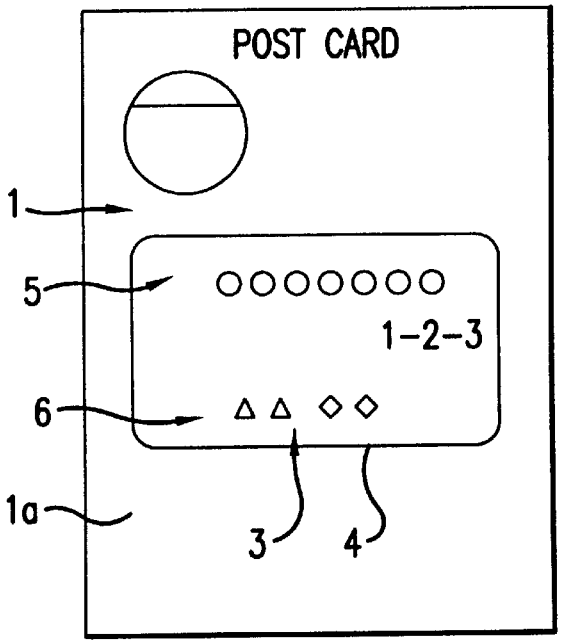
FIG. 1 is a front view of a postcard according to one example of the present invention.
Figure 2:
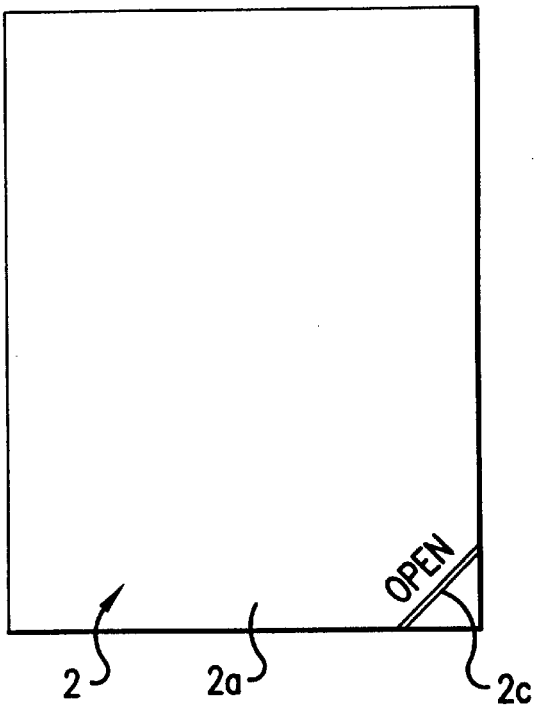
FIG. 2 is rear view of the postcard.

Several aspects of the invention are hereinafter described in detail with reference to FIGS. 1 to 7.

The first aspect of the invention is, as shown in FIGS. 1 to 4, a postcard with addressee information comprising an address portion 5 and a name portion 6.

This postcard is composed of a first sheet 1, a second sheet 2 having approximately the same form as the first sheet 1, and an adhesive layer 7 removably bonding a backside 1*b* of the first sheet 1 to a backside 2*b* of the second sheet 2.

The adhesive layer 7 serves for bonding the backside 1*b* of the first sheet 1 and the backside 2*b* of the second sheet 2 to each other, and is comprised of a first adhesive layer 7*a* bonded to a backside 1*b* of the first sheet 1, and a second adhesive layer 7*b* bonded to a backside 2*b* of the second sheet 2 and capable of bonding to the mentioned first adhesive layer 7*a*. In the mentioned state that the first sheet 1 and second sheet 2 are bonded to each other, the first adhesive layer 7*a* and second adhesive layer 7*b* are separably or removably bonded to each other.

Peeling the first sheet 1 and second sheet 2 from each other means peeling the first adhesive layer 7*a* and second adhesive layer 7*b* from each other, and once peeled, they will not be able to bond to each other again, in other words, the original bonded state cannot be restored. One corner of the second sheet forms a notch 2*c* cut out in a triangle form, and only this small notched portion is exposed, where the second sheet and the first sheet does not lie one upon another (i. e., is not overlapped) thereby allowing the first sheet 1 to be easily peeled from the second sheet by starting the peeling from this portion.

The first sheet 1 is surrounded, in a rectanglur form, by cutting line 4, and has an approximately rectanglur card portion 3 with addressee information 5 and 6 on the front side. For handling this card portion 3, it is preferable that the card portion 3 has approximately the same size as a prepaid calling card. As shown in FIG. 1, the card portion 3 is preferably located right below a column where postal (zip) code is filled out, and the addressee information filling the card portion 3 is of course used as an addressee of the postcard. By either separating or as it is, the card portion 3 may be also used as various kinds of ways such as invitation card, admission ticket for concert or sport event like a baseball, lottery ticket, discount ticket for shopping, a complimentary ticket, exchange ticket for a gift, membership card for various kind of facilities, registration card, certification card for attending a lecture, card for various management, etc. Further, the card portion 3 may be utilized as a passenger ticket for one day, or a coupon for travel.

It is also preferred that necessary information such as conditions for using the card portion 3 as any of the mentioned cards are preliminarily described or printed on the backside of the card portion 3. Instead of describing such information on the backside of the card portion 3, it is also satisfactory to describe the information on the backside 1*b* of the first sheet or the front side 2*a* or 2*b*, other than the back side of the card portion 3 of the second sheet 2.

The cutting line 4 is composed of a plurality of notches intermittently formed from the front side la of the first sheet to the first adhesive layer 7*a* on the backside 1*b*, enabling the card portion 3 to be easily cut out manually from the first sheet 1. Thus, the cutting line 4 is preferably formed by a process known in the printing industry as the Thompson process for easy cutting, such that after the first sheet 1 and the second sheet 2 are peeled from each other, only the card portion 3 may be cut out from the first sheet easily and reliably without resorting to any cutting tool. The card portion 3 does not separate easily from the first sheet 1 during mailing, because the card portion 3 is solidly connected with the body of first sheet 1 though the cutting line 4 is formed, and because the backside 1*b* of the first sheet 1 is bonded to the backside of the second sheet 2 through the adhesive layer 7.

On the other hand, the card portion 3 may be cut out easily from the first sheet 1, upon peeling the first sheet 1 from the second sheet 2, after delivery of the postcard. Accordingly, although there is an undesirable possibility that the card portion 3 may be accidentally cut out from the first sheet 11 and lost, whereby the addressee information 5 and 6 is lost from the postcard and finally the postcard is not delivered to the intended addressee, if the first sheet 1 is provided with the card portion 3 simply by the cutting line 4 without bonding to the second sheet 2. In this example of the invention, however, the backside of the card portion 3 is bonded to the backside 2*b* of the second sheet 2 through the adhesive layer 7, whereby the postcard may be surely delivered to the addressee without accidentally peeling the card portion 3 from the first sheet 1 during mailing.

According to the above construction, since the first adhesive layer 7*a* on the backside 1*b* of the first sheet 1 and the second adhesive layer 7*b* on the backside 2*b* of the second sheet 2 are peeled, after the postcard has been delivered to the addressee shown on the front side 1*a* of the first sheet 1 keeping the state that the backside 1*b* of the first sheet 1 and the backside 2*b* of the second sheet 2 are bonded through the adhesive layer 7, the card portion 3 may be utilized, independently of the first sheet 1 and second sheet 2, for other uses just by cutting out the card portion 3 from the first sheet 1 along the cutting line 4. As a result, card user may handle this separated card portion 3 easily as a card just like a telephone card, because it is not necessary for the card user to carry the entire postcard but carry only the card portion 3 having approximately the same form and dimensions as a prepaid calling card. It is not necessary for the card user to fill up an address and name in the card portion 3, because the addressee information 5, 6 are previously printed on the card portion by printing, etc.

Furthermore, since the addressee information 5, 6 of the postcard may be used also as a part of card portion 3 just as it is, it is not necessary for a sender of postcard to fill out the card portion 3 with same address and name in addition to the addressee information 5, 6 of the postcard.

A preferable method for filling out the card portion 3 with the addressee information 5, 6, is printing the addressee information 5, 6 directly onto the front side of the card portion 3, or sticking a seal having the addressee information 5, 6 printed onto the front side.

When required, any additional information of a customer may be described on the card portion 3 by a bar coding system.

Figure 3:
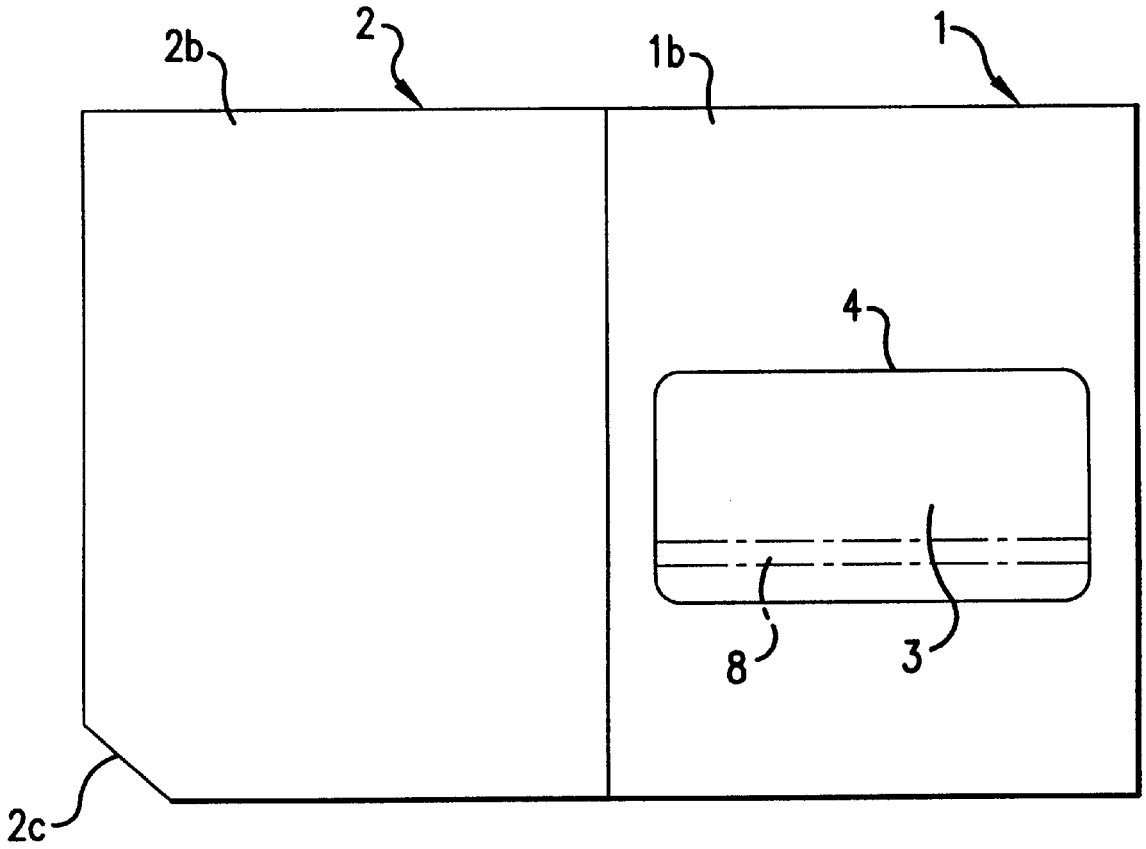
FIG. 3 is a development showing a peeled state of the first sheet and second sheet of the postcard.
Figure 4:
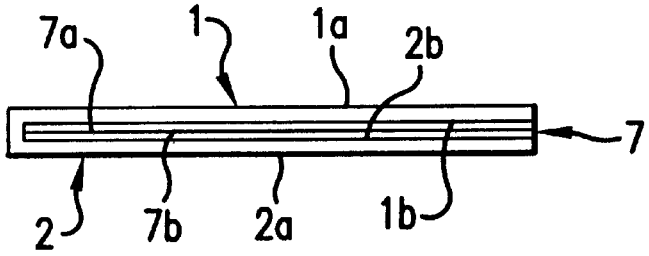
FIG. 4 is an enlarged plan view of the postcard.

Further, it is also preferable that required information is magnetically recorded in a strip-like magnetic recording portion 8 formed by photogravure or the like on the backside side of the card portion 3 corresponding to the backside 1*b* of the first sheet indicated by the one dot chain line, as shown in the FIG. 3. Also, discount point applied to customers may be automatically managed by a computer utilizing such magnetic recording portion 8 of the card portion 3, by passing the magnetic recording portion 8 through a customer information reader in a manner of card scan when the card portion 3 is used in certain shops.

Furthermore, the magnetic record portion 8 is effectively prevented from being physically damaged during mailing because the magnetic recording portion 8 is exposed neither on front side nor on backside of the postcard, and is located inside the postcard, i.e., on the backside 1*b* of the first sheet. Accordingly, it is not necessary to mail the card portion 3 having the magnetic record portion 8 in an envelope, but it is possible to mail it simply with the postcard of the invention.

In addition, it is feasible to exhibit a function of protective membrane for protecting the magnetic recording portion 8, just by forming the first adhesive layer 7*a* on the surface of the magnetic recording portion 8. It is also possible to prohibit a magnetic card portion having the magnetic recording portion 8 from counterfeiting, just by selecting a material suitable for the adhesive layer or by providing a suitable plastic layer in addition to the mentioned adhesive layer.

In the postcard of above construction, it becomes possible to deliver the postcard to the addressee shown on the front side 1*a* of the first sheet 1 keeping the state that the backside 1*b* of the first sheet 1 and the backside 2*b* of the second sheet 2 are bonded through the adhesive layer 7. After having delivered the postcard to the addressee, the backside 1*b* of the first sheet 1 and the backside 2*b* of the second sheet 2 are peeled, and it becomes possible to utilize the card portion 3 independently of the first sheet 1 and second sheet 2, just by cutting out the card portion 3 from the first sheet 1 at the cutting line 4. Thus, as mentioned above, a card user may handle this separated card portion 3 easily as a card just like a telephone card, because it is not necessary for the card user to carry the entire postcard but carry only the card portion 3 having approximately the same form and dimensions as a prepaid card for calling card. Since the addressee information 5, 6 are previously printed on the card portion by printing, etc., it is not necessary for the card user to fill up the card portion 3 with his name and address after the delivery, either.

Further, since the addressee information 5, 6 of the postcard may be used also as a part of card portion 3 just as it is, it is not necessary for a sender of postcard to fill out the card portion 3 with the same address and name in addition to the addressees 5, 6 of the postcard.

Furthermore, in the mentioned postcards provided with a magnetic recording portion on backside side of the first sheet 1 for the card portion, since the magnetic recording portion 8, being located inside the postcard i.e., on the backside 1*b* of the first sheet 1, is exposed neither on front side nor on backside of the postcard, the magnetic record portion 8 is effectively prevented from being physically damaged during mailing. Accordingly, it is not necessary to mail the card portion 3 having the magnetic record portion 8 in an envelope, but it becomes possible to mail it simply with the postcard of the invention.

In addition, it is feasible to exhibit a function of protective membrane for protecting the magnetic recording portion 8, just by forming the first adhesive layer 7*a* on the surface of the magnetic recording portion 8. It is also possible to prohibit a magnetic card portion having the magnetic recording portion 8 from counterfeiting, just by selecting a material suitable for the adhesive layer or by providing a suitable plastic layer in addition to the mentioned adhesive layer.

Figure 5A:
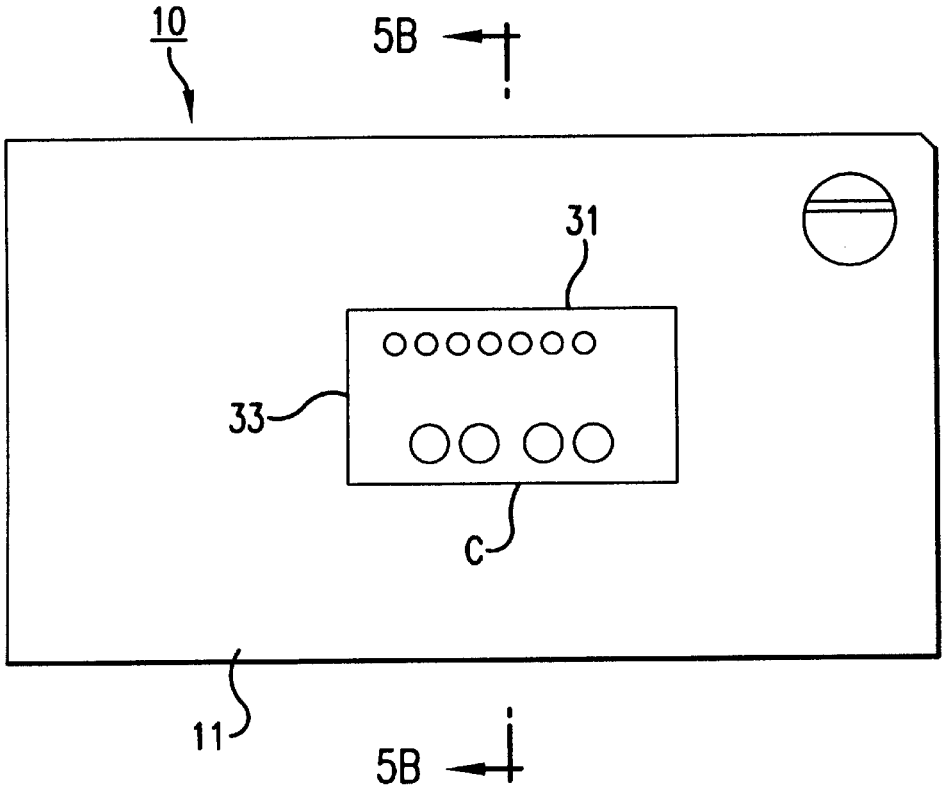
FIG. 5(*a*) is a front view of an envelope according to the present invention, and FIG. 5(*b*) is a sectional view taken along the line A—A line.
Figure 5B:
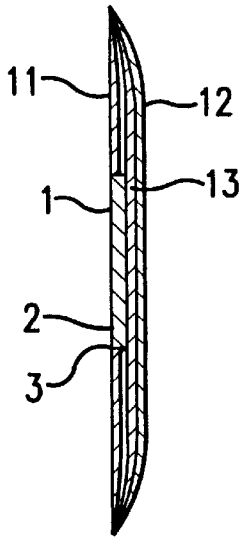
Figure 6:
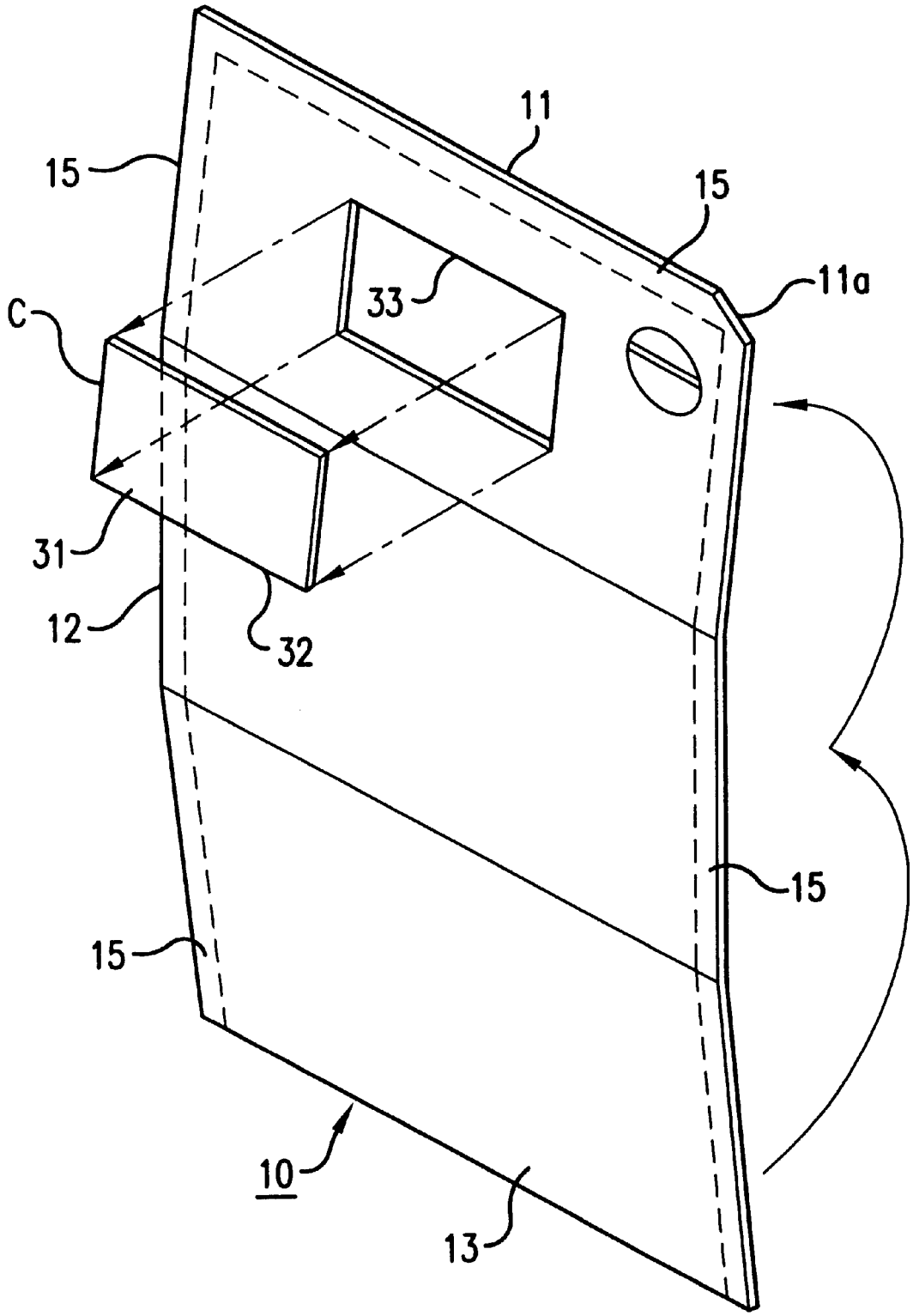
FIG. 6 is a schematic perspective view showing a state of using he envelope according to the invention.

Next, a second aspect of the invention is hereinafter described referring to the FIGS. 5 and 6. The second aspect relates to an envelope. It is preferable to form a type of envelope in which a long and narrow sheet 10 is folded in three or four layers, and a sticking margin 15 of each sheet with a glue applied and formed for applying the glue around the sheet 10 is pasted up together. For example, as shown in FIG. 6, the sheet 10 comprising a first sheet 11, a second sheet 12 and a third sheet 13 are folded in three layers. For overlapping the third sheet 13 and second sheet 12 to each other and overlapping the second sheet 12 and first sheet 11 to each other, a glue used for closely sticking a postcard described above with reference to the conventional art is applied to three edge portions of the first sheet 11, and to two edge portions of the second and third sheets 12 and 13, and then a notch portion 11*a* is formed at the corner portion of the first sheet 11. The envelope formed by this arrangement is easy to open.

The center of the first sheet 11 is formed into a card portion C having approximately the same dimensions as a prepaid calling card. Front side of the card portion C is a portion 31 to be filled out with an addressee information such as name and address, and it is on the backside to show a statement that this is a lottery, a membership card, etc., and in which various kinds of information is recorded by bar code or a magnetic strip when required. If any information is in high density, various kinds of card 32 such as an IC card, magnetic card, a memory card or the like are solidly joined to the body on the backside of card portion C.

Surrounding such card portion C, a cutting line 33 is formed so that the card portion C may be cut out easily from the first sheet 11. For that purpose, it is preferable that the cutting line 33 is formed by a process known in the printing industry as the perforation or notch provided by Thompson process.

In the sheet 10, other than the card portion C of this first sheet 11, literature of advertisements or articles of association are described. When required, a fourth sheet, a fifth sheet etc. (not illustrated) added to the third sheet 13 may be folded, whereby it becomes possible to not only provide a lot of information but also insert a lot of illustrations and/or pictures, thus improving the information quantity.

How to use the envelope of above construction according to the invention is hereinafter described. A sender of the envelope first fills out the portion 31 on the front side of the first sheet 11 with addressees such as name, address, member code, etc., and a statement that this is a lottery, a membership card, etc. is described on the backside, and in which various kinds of information is recorded by bar code or a magnetic strip and various kinds of card 32 are solidly joined as described above, when required. An envelope is formed by overlapping the third sheet 13 (overlapped on the second sheet 12) on the cards 32 and by pasting together the glued portions of the gluing margin 15 on both edge portions. As a result, for mailing a lottery ticket, a member card or various kinds of other cards 32, it is not necessary for a sender to enclose any separate card in which name, address or other information is separately described in addition to those on the envelope.

Furthermore, since various kinds of cards 32 are enclosed solidly in an envelope, it becomes possible to mail them as a standard-size mail even when the envelope has a certain extent of thickness. In this connection, it is also possible to mail them being enclosed with a thick paper (not illustrated) or with a cardboard in which a window portion having same dimensions as the various kinds of cards (not illustrated) is formed on the backside side of the second sheet 12, whereby the cards 32 may be more completely prevented from being broken or damaged.

To open the envelope, the receiver of such envelope peels the glue starting from the notch 11*a*. Because the glue is not applied to the edge portion of the third sheet 13, the envelope is easily transformed to a large sheet 10 shown in FIG. 6. Then, the receivers read through advertisements, articles of association, etc. described on the backside of the sheet 10, and cut out the card portion 10 from the first sheet 11 along the cutting line 33. The receivers may cut out the card C easily from the first sheet 11, because the fist sheet 11 is in a state developed from the second sheet 12 and third sheet 13, and the cutting line 3 is a perforation.

The cutout card C may be carried compactly as membership card, management card, etc. as a matter of course. In particular, the card C may be put into a pass holder by forming the card portion C to be substantially same dimensions as a prepaid card for calling.

As has been described so far, according to the present invention, it is now possible to cut out the card portion C from the envelope easily, and the cutout card portion C may be used as membership card, management card, as a result of describing various kinds of information on the backside side of the portion filled out with the addressee information for the envelope, or preparing the card portion C solidly integrated with various kinds of cards and forming a cutting line surrounding the card portion C.

Thus, working efficiency is improved because the sender may save a lot of time and labor of separately enclosing a membership card or other card filled out with the same addressee information as on the envelope. Convenience is also improved because the sender may bring a compact membership card, ID card, compact memory card or the like having approximately same dimensions as a prepaid calling card, without carrying envelope.

It becomes also possible to mail various kinds of cards including IC card without any damage, as a result of making the card portion C by utilizing a part of envelope. Further, utilization of an envelope folded into three or four, i.e., from the first to the third (or more than forth) sheets 11, 12, 13, etc. makes it possible to insert a lot of information, illustration and picture in any portion of the envelope other than the card portion C.

Therefore, it may be said the sender intends to promote the use of a card, while the receiver comes to understand easily how to use a card.

Figure 7:
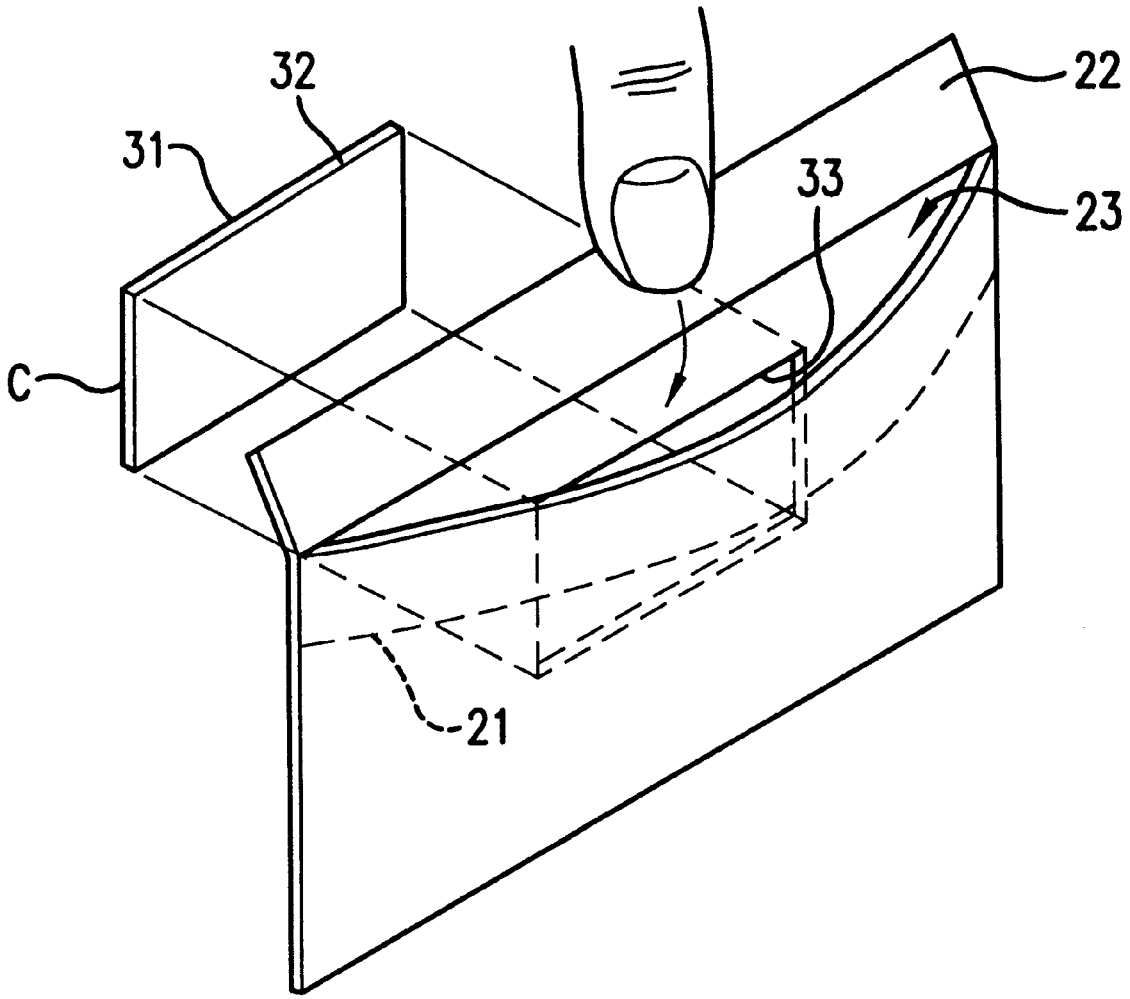
FIG. 7 is a schematic perspective view showing a modification of the envelope according to the invention.

It is to be understood that the invention is not limited to the forgoing specific form of the embodiment, but several changes and modifications may be made without departing from the spirit and technical scope of the invention. For example, as shown in FIG. 7, an envelope may be prepared by forming longitudinally a turn portion 22 provided with a perforation 21 so that the envelope is opened on the long side just by cutting the perforation. Since such an envelope is opened on the long side, the opened long side becomes a large opening 23, thereby making it possible to put a finger into the opening 23, and cut out easily the portion where addressee information is filled out.

What is claimed is:

1. A postcard comprising:

a first sheet having a front side and a back side, said first sheet including a card portion on which addressee information is present on the front side;

a second sheet of similar size as said first sheet, having a front side and a back side, said second sheet lying on said first sheet so that the back side of said first sheet and the back side of said second sheet face each other and cannot be seen;

an adhesive layer being arranged between said first sheet and said second sheet for removably bonding the back side of the first sheet to the back side of the second sheet;

said card portion being surrounded by a cutting line which allows said card portion to be removed from said first sheet;

said card portion being held to said second sheet by said adhesive layer so that said card portion can not accidentally be removed from said first sheet.

2. A postcard according to claim 1, wherein a magnetic recording portion is attached to the back side of said card portion and is covered by a protective membrane.

3. A postcard according to claim 2, wherein said adhesive layer acts as said protective membrane.

4. A postcard according to claim 1, wherein said cutting line includes a plurality of intermittent notches.

5. A postcard according to claim 1, wherein one of said first sheet and said second sheet has a notch whereby a recipient of the postcard may separate the front sheet from the back sheet.

* * * * *